US006802144B2

(12) United States Patent
Szilagyi

(10) Patent No.: US 6,802,144 B2
(45) Date of Patent: Oct. 12, 2004

(54) FURNITURE ORNAMENT

(76) Inventor: Barbara Szilagyi, 64-04 Flushing Ave., Apt. 3F, Maspeth, NY (US) 11378

( * ) Notice: Subject to any disclaimer, the term of this patent is extended or adjusted under 35 U.S.C. 154(b) by 612 days.

(21) Appl. No.: 09/764,715

(22) Filed: Jan. 17, 2001

(65) Prior Publication Data

US 2003/0035294 A1 Feb. 20, 2003

(51) Int. Cl.[7] ..... G09F 19/00
(52) U.S. Cl. ..... 40/615; 40/577
(58) Field of Search ..... 40/560, 382, 534, 40/427, 435, 442, 577, 615; 353/35, 79; 312/114, 117; 108/149, 180, 93; 211/117, 118, 113, 149, 106, 145

(56) References Cited

U.S. PATENT DOCUMENTS

| | | | | | |
|---|---|---|---|---|---|
| 2,105,008 | A | * | 1/1938 | Riley | 40/615 |
| 2,488,955 | A | | 11/1949 | Wood | 88/24 |
| 2,846,921 | A | | 8/1958 | Glass | 88/27 |
| D212,708 | S | | 11/1968 | Mayer | D48/23 |
| 3,445,159 | A | | 5/1969 | Hoppmann | 353/35 |
| 3,472,587 | A | | 10/1969 | Liguori | 353/35 |
| 3,561,859 | A | | 2/1971 | Heckscher et al. | 353/25 |
| 3,679,297 | A | | 7/1972 | Searle et al. | 353/14 |
| 3,680,227 | A | * | 8/1972 | Pavelle | 434/98 |
| 3,683,779 | A | | 8/1972 | Lifton | 95/85 |
| 3,822,938 | A | | 7/1974 | Hirsch | 353/121 |
| 4,185,913 | A | | 1/1980 | Ammann et al. | 355/43 |
| 4,246,605 | A | | 1/1981 | La Russa | 358/104 |
| 4,249,806 | A | | 2/1981 | Tokhadzhe | 353/30 |
| 4,645,319 | A | | 2/1987 | Fekete | 353/31 |
| 4,756,614 | A | | 7/1988 | Kato et al. | 353/35 |
| 4,843,528 | A | | 6/1989 | Pearce-Harvey et al. | 362/322 |
| D303,437 | S | | 9/1989 | Mason | D26/72 |
| 5,331,359 | A | | 7/1994 | Leclerq | 353/28 |
| 5,649,827 | A | | 7/1997 | Suzaki | 434/284 |

* cited by examiner

*Primary Examiner*—Cassandra Davis
(74) *Attorney, Agent, or Firm*—Steven Horowitz

(57) ABSTRACT

A furniture ornament comprised of a plurality of parallel and spaced-apart double-layered planar sheets of transparent material, e.g. rigid plastic. The sheets contain designs usually having repeating patterns thereon wherein all of the designs on the sheets are visually superimposed on one another to create a composite design when looking perpendicularly at the sheets, and wherein a view from the side at an angle shows fewer of the sheets superimposed on one another, providing an unusual three-dimensional visual effect. In an embodiment for a ceiling lamp, the viewer looks up toward the light placed between the uppermost sheet and the ceiling and sees the superimposed designs as one design. Chains hanging from the ceiling maintain the sheets in spaced-apart relation to one another with attachment member Other embodiments include a design for a table and for the front of a door that may not have an independent source of light.

19 Claims, 5 Drawing Sheets

FURNITURE ORNAMENT

The present invention relates to furniture ornaments and more particularly to furniture ornaments, such as ceiling lamps, that provide a unique three-dimensional visual effect.

There is a great need for furniture that is visually appealing and that includes designs that can appear to be three-dimensional. Yet to have an actual three-dimensional design would be complicated and expensive. Furthermore, it would be a fixed design not custom-tailored to the desires and tastes of each customer. A design appearing to be three-dimensional yet in actuality composed of discrete two-dimensional designs on elements of a furniture ornament and where the two-dimensional designs can be varied and selected according to the taste of the customer is highly desirable.

Furniture ornaments that create a unique visual effect can be particularly interesting and can enhance the appeal of any piece of furniture. Unique visual effects that appear as part of a light fixture are particularly interesting since the light magnifies the visual effect. In some cases it would also be advantageous to allow purchasers of furniture to be able to select artwork that would appear in the furniture or even to supply there own two-dimensional artwork and have the furniture contain that two-dimensional design.

The furniture ornament of the present invention fulfills all of these characteristics and more. In sum, the furniture ornament of the present invention is versatile enough to be a lamp fixture, a door, a table or any other piece of furniture that can be comprised of a plurality of parallel and spaced-apart double-layered planar sheets of transparent material wherein the sheets contain two-dimensional designs typically although not necessarily having repeating patterns thereon and wherein all of the designs on the sheets are visually superimposed on one another when looking perpendicularly at the sheets, and wherein a view from the side at an angle shows fewer of the sheets superimposed on one another, providing an unusual three-dimensional visual effect. These and other important features will be described in further detail below.

OBJECTS AND ADVANTAGES

The following important objects and advantages of the present invention are:

(A) to provide a furniture ornament that provides a unique three-dimensional visual effect from individual two-dimensional designs, (B) to provide a light fixture that when looking up at it allows the observer to see a composite view of all designs that appear on the sheets of the light fixture which composite design has a three-dimensional visual effect, (C) to provide a furniture ornament comprised of a plurality of parallel and spaced-apart double-layered planar sheets of transparent material, e.g. rigid plastic, having two-dimensional designs thereon such that all of the designs on the sheets are visually superimposed on one another when looking at the furniture ornament from below perpendicularly at the sheets, (D) to provide such a furniture ornament wherein the designs have repeating patterns, such as natural greenery, or other designs capable of forming part of a composite visual design, (E) to provide a furniture ornament that can create a unique visual effect whether in the form of a light fixture, such as a ceiling lamp, or in the form of a table, door etc., (F) to provide a furniture ornament comprised of a plurality of parallel and spaced-apart preferably double-layered, planar sheets of transparent material having two-dimensional designs thereon such that when looking at the furniture ornament from below or above at an angle when an observer looks at the furniture ornament such as a ceiling lamp, from an angle from below or above the furniture ornament, only a portion of a full design of each sheet is visually superimposed on the designs of the other sheets, and that portion represents a decreasing proportion of the full design the further the full design is from the observer, (G) to provide a light fixture having the characteristics as described and wherein a light source is situated between the ceiling and the topmost sheet, (H) to provide a furniture ornament that allows a customized design that reflects personal artwork supplied by the purchaser.

DETAILED DESCRIPTION OF THE PREFERRED EMBODIMENT

Figure 1:
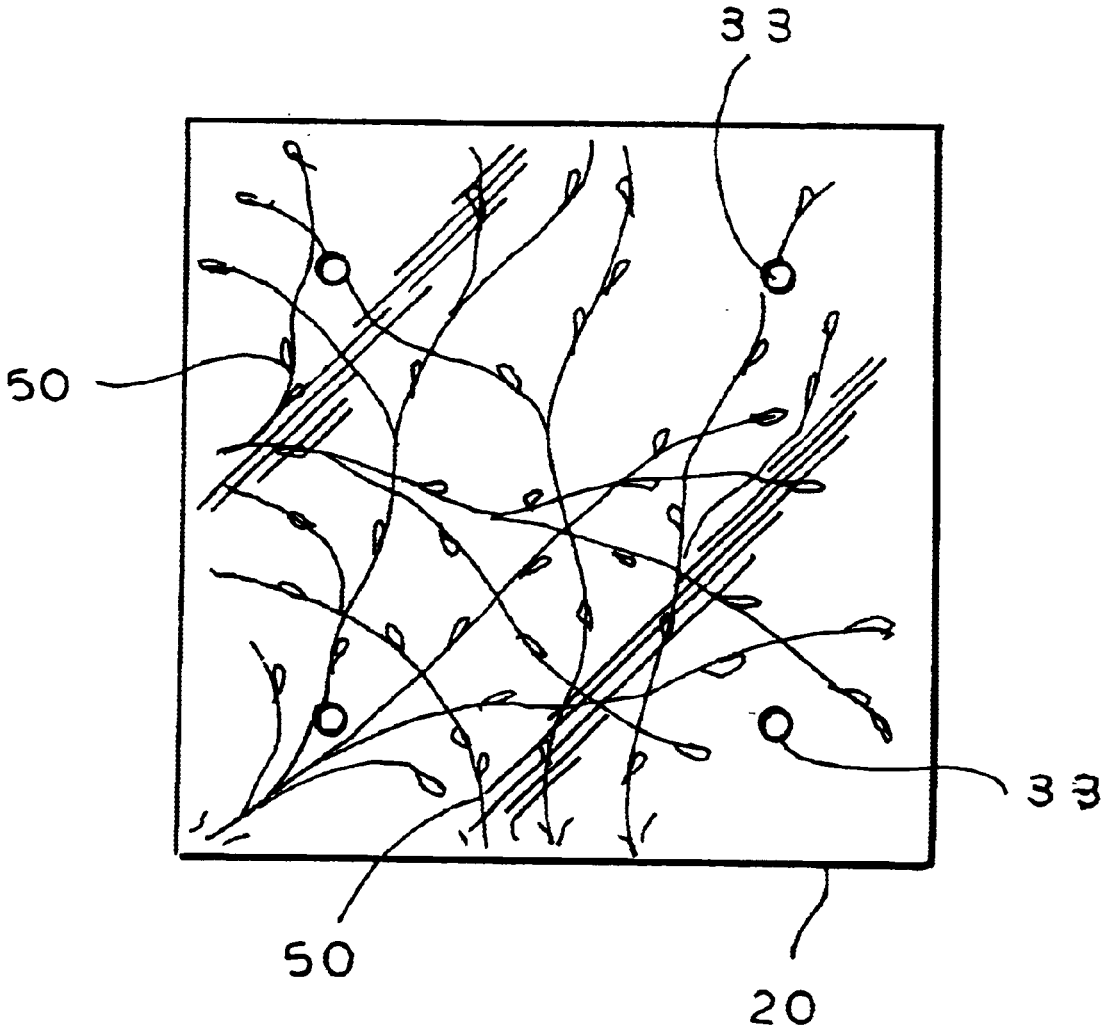
FIG. 1 is a top plan view of the furniture ornament of the present invention showing a composite design through three sheets.

In order to better understand the present invention in conjunction with the drawings of FIGS. 1–6, the furniture ornament of the present invention has been assigned reference numeral 10 and its elements are described and assigned the reference numerals identified below.

Furniture ornament 10 provides a unique visual effect. Furniture ornament 10 can be a light fixture, such as a ceiling lamp, or it can be something else entirely, such as a coffee table, a door or many other kinds of ornamental furniture. As best seen in FIGS. 2, 3, 4, 6A furniture ornament 10 is comprised of a plurality of spaced-apart and parallel planar sheets 20*a*, 20*b*, 20*c*, of rigid transparent material. Although rigid material is preferred since the lack of bending eliminates visual distortions caused by bends, it is also contemplated that flexible transparent materials can be used.

Figure 2:
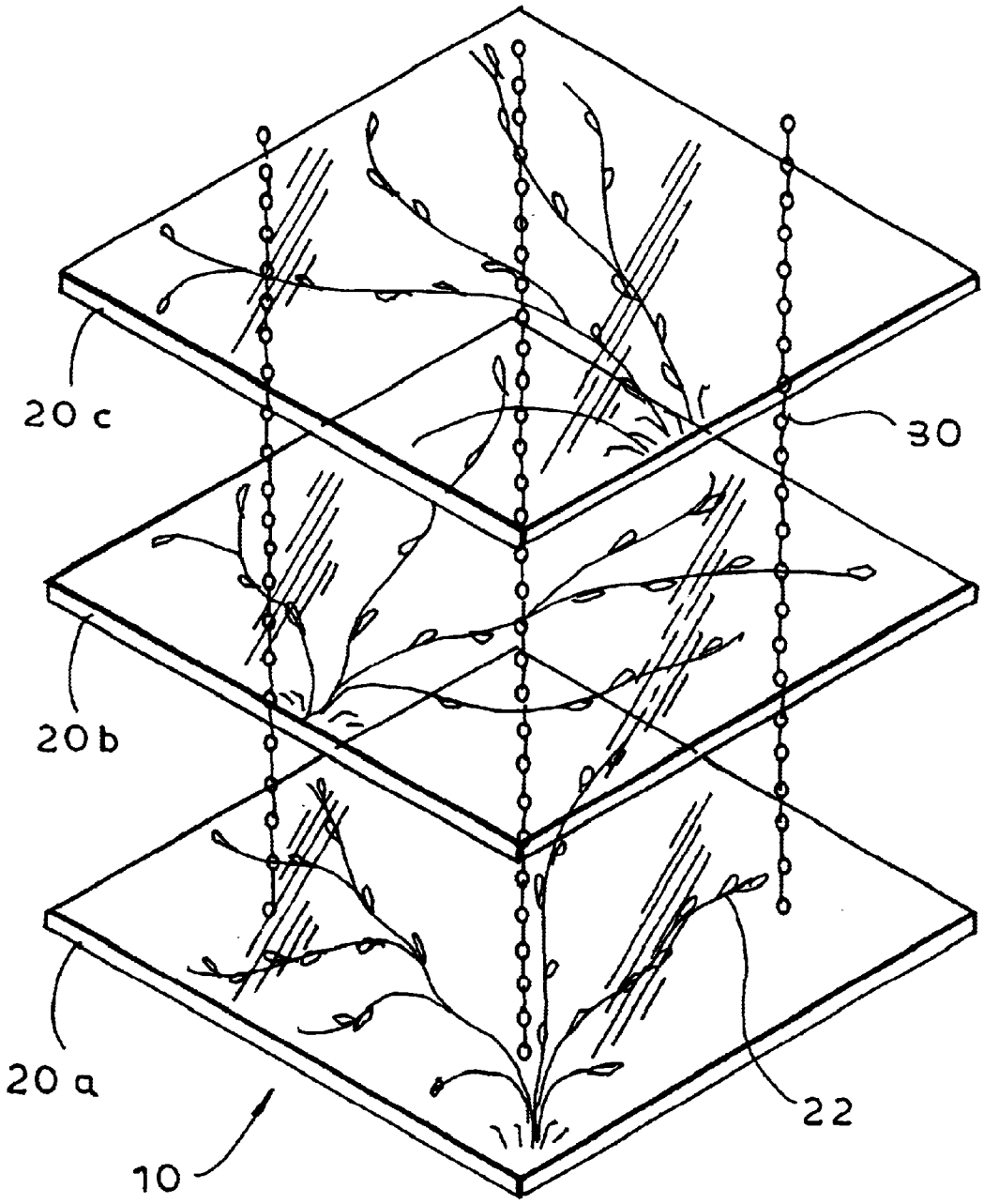
FIG. 2 is a perspective view of the furniture ornament of the present invention.
Figure 3:
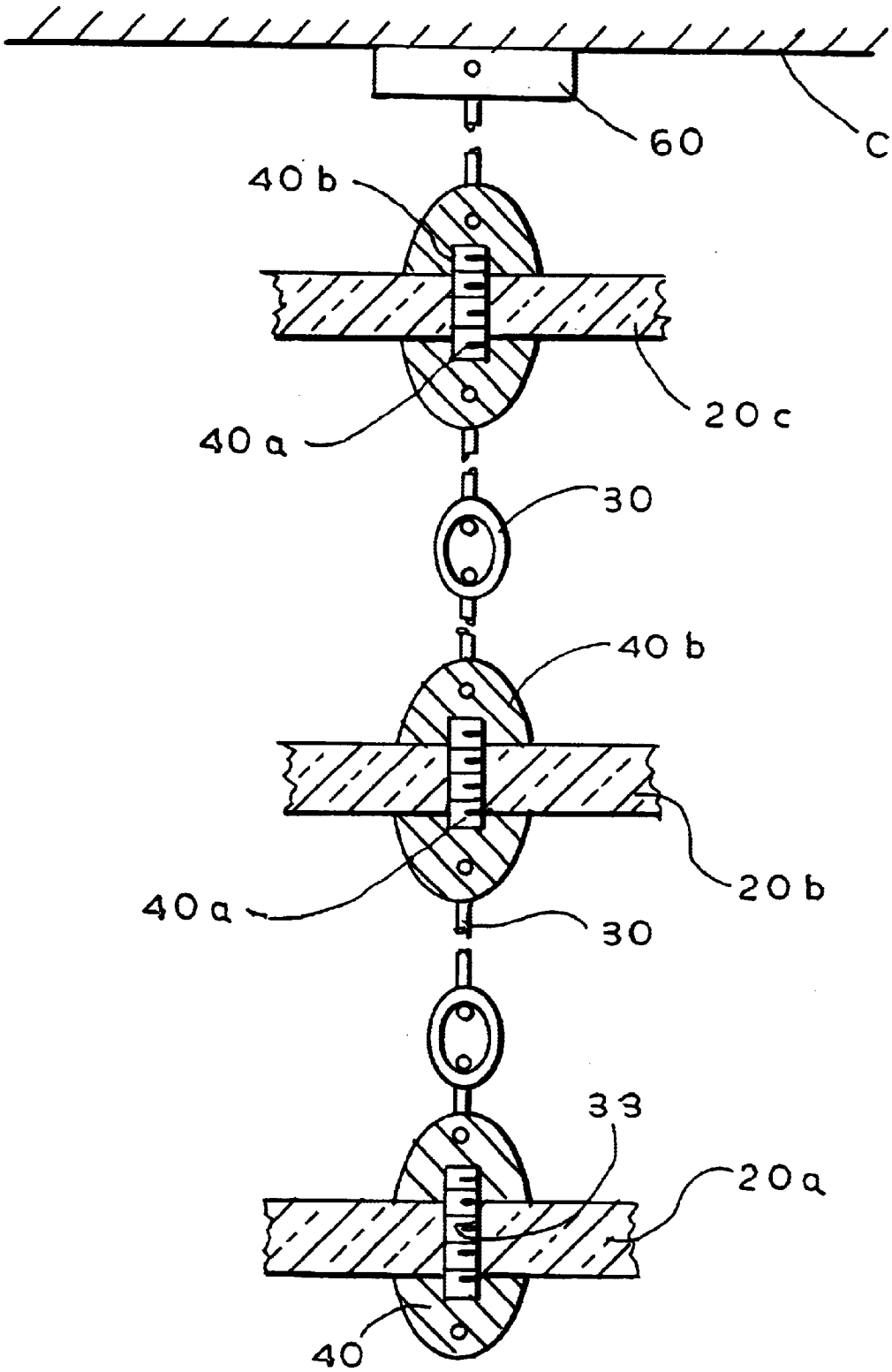
FIG. 3 is a detailed sectional view of the furniture ornament of the present invention showing the mounting of the connectors.
Figure 4:
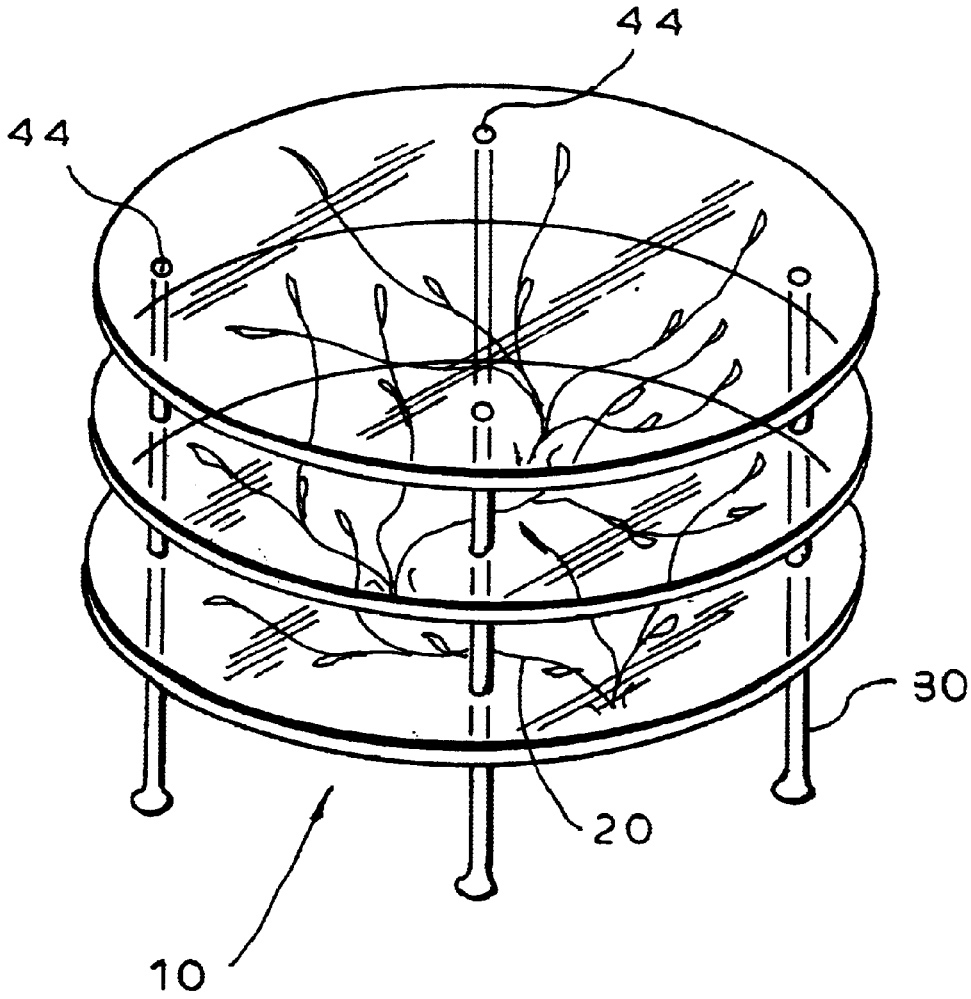
FIG. 4 is a perspective view of a furniture ornament of the present invention in the form of a table.

As best seen in FIGS. 2, 4 each sheet 20 contains thereon a two-dimensional design 22. Sheets 20 may be made of any variety of suitable hard transparent plastic or glass or any other transparent preferably rigid material. When the furniture ornament 10 is a ceiling light fixture, as in FIGS. 1–3, then sheets 20 may be as lightweight as possible or in other embodiments may be heavier glass or other materials, depending on the user's preference. When furniture ornament 10 is a table, as in FIGS. 4, 5, then sheets 20 are rigid plastic, glass or other material and are typically heavier. Sheets 22 are ideally double layered for greater durability although it is not a requirement that they be double layered. The number of sheets that make up the plurality of sheets 20 is two or more.

As best seen in FIGS. 1–2, 4 the designs 22 include repeating patterns such as natural, sprouting greenery or leaves of a tree that when visually superimposed on one another create the effect of more dense greenery or leaves. This is just an example of a repeating pattern and other examples can be of anything else. The phrase "repeating pattern" as used herein merely means that at least one element in the design 22 repeats itself in that design, meaning that element exists at least twice in that design 22.

The repeating pattern of one of the sheets of sheets 20 may or may not be a different design than the repeating pattern of another sheet 20 of sheets 20. For example, a design 22 of angels in the middle of bottommost sheets 20*a* can be visually superimposed on a design 22 of clouds on the outer portions of adjacent sheet 20*b*. In that example, the composite of the two sheets would be angels surrounded by clouds.

The present invention contemplates the use of any combination of designs 22 on the sheets 20 that result in a composite design 50 when the sheets 20 are observed in a line of sight which composite design 50 is different from individual designs 22 and is visually attractive. Accordingly, repeating patterns on designs 22 are typical but not a necessary requirement for the present invention.

The design 22 on the bottommost sheet 20*a* should not be exactly identical to the design on the adjacent sheet 20*b* since then the composite of the two will not add anything when the observer's line of sight is perpendicular to the bottommost sheet 20*a*. In certain embodiments, in order to maximize the visual effect of visual superimposition of designs 22, the designs 22 from one sheet 20 to another are essentially similar, although not identical. Being non-identical, however, includes differences merely in placement. For example, the two dimensional design 22 that is placed on bottommost sheet 20*a* may be the same design 22 on adjacent sheet 20*b* except that the design 22 on adjacent sheet 20*b* has a different vertical and/or horizontal axis—meaning it is disturbed (or "moved over") both vertically and horizontally. That would allow an interesting composite if the design 22 itself is a repeating pattern such as the view of natural greenery made of leaves.

As seen in FIG. 1, the designs 22 on all the sheets 20 are visually superimposed on one another when viewing the furniture ornament 10 on a line of sight that is perpendicular or substantially perpendicular to the sheets 20. For example, when looking up at a ceiling lamp 10 directly from directly below the bottommost sheet 20*a*, the observer sees all the designs 22 on all the sheets 20 as one composite design 50 that appears to be located on the bottommost sheet 20*a* Ceiling lamp 10 would include a light source 80 located between the uppermost sheet 20*c* and the ceiling. Other embodiments include a design for a table, see, e.g. FIG. 5, and for the front of a door that may or may not have an independent source of light.

Sheets 20 are ideally equidistantly spaced apart from the best visual effect but that it is not a necessity and the amount of space between sheets 20 depends on the particular visual effect desired.

As can be seen from FIGS. 2, 4 when the observer views the furniture ornament 10 from an angle from below or even above the furniture ornament 10, then less than all and only a portion of the full design 22 (i.e. the full two-dimensional design) that appears on the bottommost sheet 20*a* (or the topmost sheet 20*c*, as the case may be) are visually superimposed on the other sheets 20*b*, 20*c* (or 20*a*, 20*b*). The remainder of the design 22 is not superimposed or is superimposed along fewer than all the sheets 20. The combination of visual superimpositions create a unique visual effect. When viewing a light fixture 10 from below at an angle, the bottommost sheet 20*a* will be superimposed less and less on sheets 20 that are further away from that bottommost sheet 20*a*. For example, based on simple geometry, a smaller fraction of bottommost sheet 20*a* will be on the same line of sight of the observer, and hence superimposed on, topmost sheet 20*c* than the sheet 20 that is, in this embodiment showing three sheets 20, called middle sheet 20*b*. In other words, when an observer looks at the furniture ornament 10 such as a ceiling lamp, from an angle from below or above the furniture ornament 10, only a portion of a full design of each sheet 20 is visually superimposed on the designs 22 of the other sheets 20, and that portion represents a decreasing proportion of the full design the further the full design is from the observer.

As best seen in FIG. 1, it is important to appreciate that the unique visual effect of the furniture ornament 10 of the present invention is that the two-dimensional designs 22 on sheets 20 appear to be extended into the space between the sheets 20 thus creating the illusion of a three-dimensional visual object. The composite design 50 thus appears to be three-dimensional. This is the case whether the observer looks at the furniture ornament 10 from an angle or whether the observer's line of sight is perpendicular to the bottommost sheet 20*a* (or the topmost sheet 20*c* as the case may be depending on the location of the observer).

Furniture ornament 10 further includes a plurality of linear connectors 30 that are substantially parallel to one another and that run from bottommost sheet 20*a* to topmost sheet 20*c*. Alternatively, connectors 30 are not substantially parallel in order to create a nonorthodox design effect, depending on the user's preference. Connectors 30 traverse apertures 33 in sheets 20 and serve to maintain sheets 20 in a spaced-apart parallel relation to one another. Furniture ornament 10 also includes attachment means 40 for attaching connectors 30 to sheets 20 and secure attachment means 60 for attaching furniture ornament 10 to a ceiling C, floor, wall, door or other fixed part of a structure.

For a light fixture hanging on the ceiling, as seen in FIG. 2, 3, connectors 30 may be chains that run from the ceiling to the lowest sheet 20*a*. Connectors 30 for a light fixture need not necessarily be chains but could also be other forms of connecting elements such as rigid tubes. The chains 30, and the same is true of the connectors 30 in general, connect to the sheets 20 by any well known means. For example, and as seen in FIG. 3, chains 30 connect by means of bolt 40 and rod assemblies 40 wherein rod 40*a* traverses equidistantly spaced apertures 33 formed therethrough in each sheet 20 and wherein bolt 40*b* secures each end of rod 40*a* to the sheet 20 and also secures itself (the bolt 40*b*) to the last link of chain 30. Similarly, chains 30 connect to the ceiling (not shown) by any suitable well known means.

Figure 5:
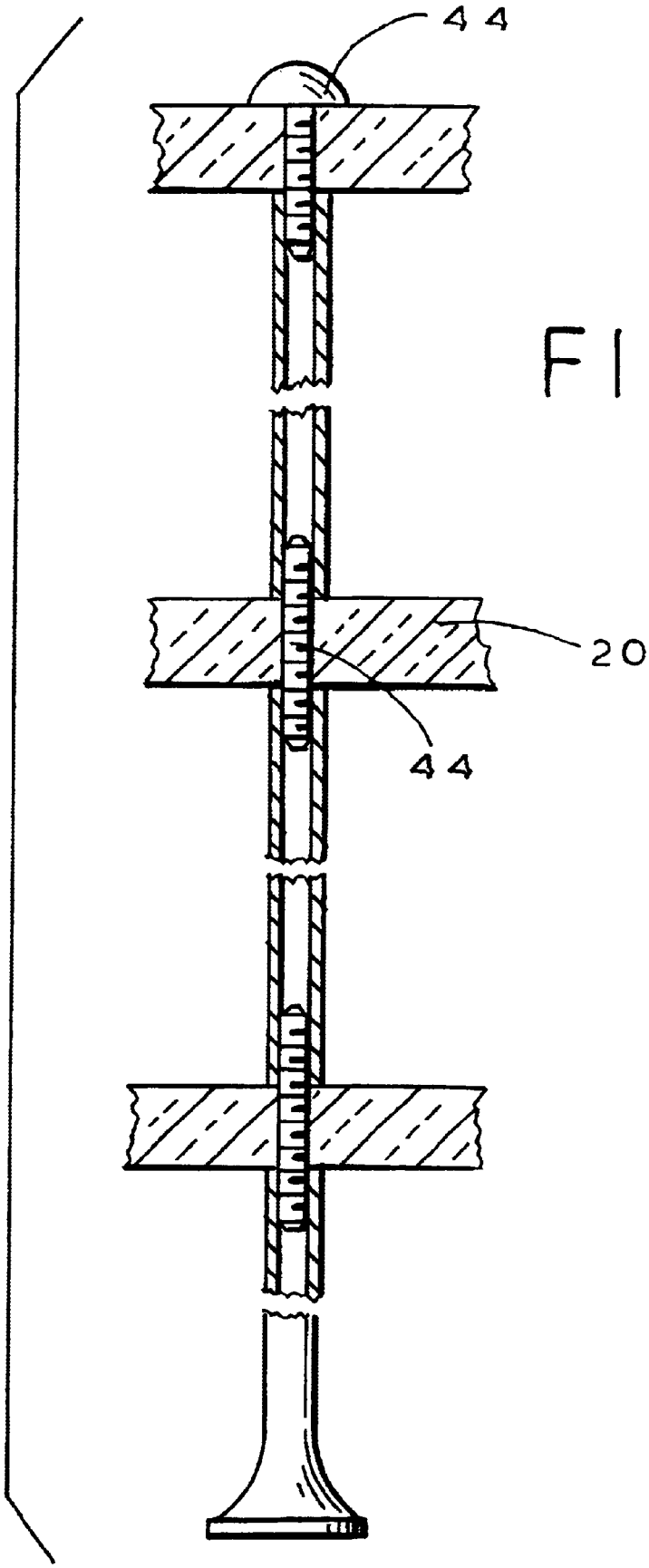
FIG. 5 is a detailed sectional view of the furniture ornament of FIG. 4 showing the mounting of the connectors.

In FIG. 5, in contrast, where furniture ornament 10 is a coffee table, connectors 30 are rigid elongated support members 30 rather than chains 30. The mounting means for these rigid elongated support members may be anything suitable and well known, such as a bolt and screw assembly 44 as seen in FIG. 5.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A furniture ornament having a unique visual effect, comprising:

a plurality of spaced-apart and parallel planar sheets of transparent material having a topmost sheet and a bottommost sheet, the sheets containing thereon two-dimensional designs, said two-dimensional designs being capable of forming a composite design when the sheets are observed in a line of sight, said composite design being different from any of the two-dimensional designs on the sheets, said composite design appearing to be three-dimensional, the two-dimensional designs on all the sheets being visually superimposed on one another when viewing the furniture ornament perpendicular to the sheets, when viewing the bottommost sheet from an angle from below or the topmost sheet from angle from above the furniture ornament, only a portion of a full design of each sheet being visually superimposed on the two-dimensional designs of the other sheets, said portion representing a decreasing proportion of the full design the further the full design is from the observer, a plurality of linear connectors running from the bottommost sheet to the topmost sheet and including structure for attaching to the sheets and maintaining the sheets in spaced-apart parallel relation to one another and including structure for attaching the connectors to a support.

2. The furniture ornament of claim 1, wherein the furniture ornament is a light fixture and the connectors are chains.

3. The furniture ornament of claim 1, wherein the furniture ornament is a light fixture, the connectors are chains that connect to the sheets by means of bolt and rod assemblies that traverse apertures in the sheets.

4. The furniture ornament of claim 1, wherein the transparent material is rigid and the connectors are substantially parallel.

5. The furniture ornament of claim 1, wherein the transparent material is rigid and the sheets are double-layered.

6. The furniture ornament of claim 1, wherein the furniture ornament is a light fixture and the sheets are double-layered.

7. The furniture ornament of claim 1, wherein the furniture ornament is a light fixture, wherein the connectors are chains that connect to the sheets by means of bolt and rod assemblies, wherein the sheets are double-layered and wherein the two-dimensional designs are of natural greenery.

8. A furniture ornament having a unique visual effect, comprising:

a plurality of spaced-apart and parallel planar sheets of rigid transparent material having a topmost sheet and a bottom most sheet, the sheets containing thereon two-dimensional designs, said two-dimensional designs including repeating patterns, said two-dimensional designs forming a composite design when the sheets are observed in a line of sight, said composite design appearing to be three-dimensional, the two-dimensional designs on all the sheets being visually superimposed on one another when viewing the furniture ornament perpendicular to the sheets, when viewing a bottommost sheet from an angle from below or a topmost sheet from angle from above the furniture ornament, only the portion of the full design of each sheet being visually superimposed on the two-dimensional designs of the other sheets, said portion representing a decreasing proportion of the full design the further the full design is from the observer, a plurality of linear substantially parallel connectors running from the bottommost sheet to the topmost sheet and including means for attaching to the sheets and maintaining the sheets in spaced-apart parallel relation to one another and including means for attaching the connectors to a ceiling, floor, wall, door or other fixed part of a structure.

9. The furniture ornament of claim 8, wherein the furniture ornament is a light fixture and the connectors are chains.

10. The furniture ornament of claim 8, wherein the furniture ornament is a light fixture, the connectors are chains that connect to the sheets by means of bolt and rod assemblies that traverse apertures in the sheets.

11. The furniture ornament of claim 8, wherein the furniture ornament is a light fixture and the repeating patterns are of natural greenery.

12. The furniture ornament of claim 8, wherein the furniture ornament is a light fixture and the sheets are double-layered.

13. The furniture ornament of claim 8, wherein the furniture ornament is a light fixture, wherein the connectors are chains that connect to the sheets by means of bolt and rod assemblies, wherein the sheets are double-layered and wherein the repeating patterns are of natural greenery.

14. A light fixture having a unique visual effect, comprising:

a plurality of spaced-apart and parallel planar sheets of rigid transparent material having an uppermost sheet and a bottommost sheet, the sheets containing thereon two-dimensional designs, said two-dimensional designs including repeating patterns, said two-dimensional designs forming a composite design when the sheets are observed in a line of sight, said composite design appearing to be three-dimensional, a light source between the uppermost sheet and a ceiling, the designs on all the sheets being visually superimposed on one another when viewing the light fixture substantially perpendicular to the sheets from below the bottommost sheet, when viewing the light fixture at an angle from below the bottommost sheet, only a portion of a full design of each sheet being visually superimposed on the two-dimensional designs of the other sheets, said portion representing a decreasing proportion of the full design the further the full design is from the observer, and a plurality of linear substantially parallel connectors running from the bottommost sheet to the topmost sheet and including means for attaching to the sheets and maintaining the sheets in spaced-apart parallel relation to one another and including structure for attaching the connectors to a support.

15. The light fixture of claim 14, wherein the connectors are chains.

16. The light fixture of claim 14, wherein the connectors are chains and wherein the chains connect to the sheets by means of bolt and rod assemblies that traverse apertures in the sheets.

17. The light fixture of claim 14, wherein the repeating patterns are of natural greenery.

18. The light fixture of claim 14, wherein the sheets are double-layered.

19. The light fixture of claim 14, wherein the connectors are chains that connect to the sheets by means of bolt and rod assemblies that traverse apertures in the sheets, wherein the repeating patterns are of natural greenery and wherein the sheets are double-layered.

* * * * *